United States Patent [19]

Murata et al.

[11] 3,952,177

[45] Apr. 20, 1976

[54] TIMER FOR MULTI-PURPOSE USE

[75] Inventors: Kingo Murata, Shiki; Shigeyuki Nishimura; Hiroshi Ogihara, both of Tokyo, all of Japan

[73] Assignee: Copal Company Limited, Tokyo, Japan

[22] Filed: Oct. 29, 1974

[21] Appl. No.: 518,898

[30] Foreign Application Priority Data

Oct. 29, 1973 Japan ..... 48-121381

[52] U.S. Cl. ..... 200/35 R; 200/38 R; 58/19 R; 58/38 R

[51] Int. Cl.[2] ..... H01H 43/10; G04C 21/16

[58] Field of Search ..... 200/33 R, 35 R, 38 R, 200/38 A, 38 F, 38 FA, 38 FB; 58/16.5, 19 R, 38 R; 340/309.4

[56] References Cited

UNITED STATES PATENTS 3,281,548 10/1966 Sears et al. ..... 200/38 A 3,708,973 1/1973 Funaki ..... 200/38 R

*Primary Examiner*—James R. Scott

*Attorney, Agent, or Firm*—Cushman, Darby & Cushman

[57] ABSTRACT

A multi-purpose timer comprising a control member, a first and second slide plates which can be operated by the control member, a microswitch which is operated by the first slide plate, a "snooze" actuating member connected to the second slide plate, a "snooze" operating member which is engageable with the second slide plate, a switch operating lever which is engageable with the first and second slide plates, and a timer setting drum, the timer mechanism, "sleep" mechanism and "snooze" mechanism being selectively used by change-over operation of the control member.

3 Claims, 13 Drawing Figures

TIMER FOR MULTI-PURPOSE USE

BACKGROUND OF THE INVENTION

1. Field of the Invention:

This invention relates generally to a multi-purpose timer, and more particularly to a timer mechanism which is attached to a clock to be assembled in a radio set or the like so as to control opening and closing of the power switch of the radio set or the like and to operate a buzzer assembled in the clock.

2. Description of the Prior Art:

Heretofore, a variety of timers such as a 24-hour timer which can open or close the switch at the desired time during the period of 24 hours and a timer with which either a "sleep" or "snooze" mechanism is combined is known in the art. In this specification, The "sleep" mechanism is defined as a mechanism that enables the switch to open after a certain specified period of time from the moment the switch was closed by manual operation and "sleep" operation is simply defined as operation caused by the "sleep" mechanism. Similarly, the "snooze" mechanism is defined as a mechanism that enables the buzzer to operate again after the predetermined time interval from the moment the operation of the buzzer was once stopped by manual operation of the user. "Snooze" operation is simply defined as operation caused by the "snooze" mechanism.

However, there has been no such timer as one which provides both the sleep and snooze mechanisms in addition to the timer being of the 24-hour type. Because the 24-hour timer with the conventional sleep and snooze mechanisms is not desirable as a timer to be built in the radio set or the like, and since assembling the conventional sleep and snooze mechanisms in the 24-hour timer would make the whole mechanism of the timer extremely complex and large, the cost of the timer could not help being expensive. Furthermore, the conventional timer which provides the "sleep" mechanism needs another switch for performing the "sleep" operation in addition to a switch assembled in the timer, and the cost of the switch is very expensive in comparison with the other parts of the timer.

SUMMARY OF THE INVENTION

It is, therefore, a primary object of the present invention to provide a timer mechanism having a relatively simply construction with only one switch, which can perform, by a simple change-over operation, a variety of operations such as 1) manual switch-on and switch-off operations, 2) timer operation (automatically switch-on at the desired time), 3) timer operation plus buzzer operation (a buzzer operates after predetermined time interval from when the switch has automatically closed), 4) the snooze operation and 5) the sleep operation.

Another object of the present invention is to provide a timer mechanism of the type described, which is constructed in a very compact mode together with a clock mechanism.

BRIEF DESCRIPTION OF THE DRAWING

Other object and features of the invention will become apparent to those skilled in the art as the disclosure is made in the following description of a preferred embodiment of the invention, as illustrated in the accompanying sheet of drawings, in which like reference character designate the same parts throughout the figures and wherein.

DETAILED DESCRIPTION OF THE PREFERRED EMBODIMENT

Figure 1:
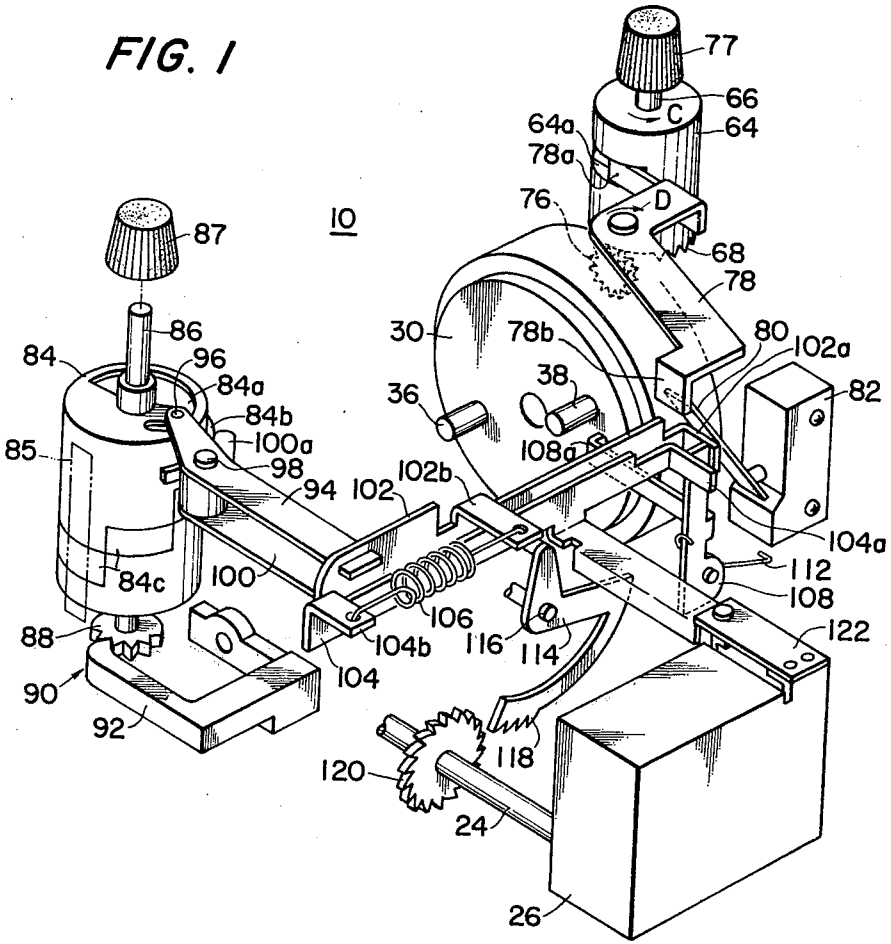
FIG. 1 shows a perspective view of the main part of the preferred embodiment of the present invention with some of the constitutional members removed for clarifying the interconnection between the parts.
Figure 2:
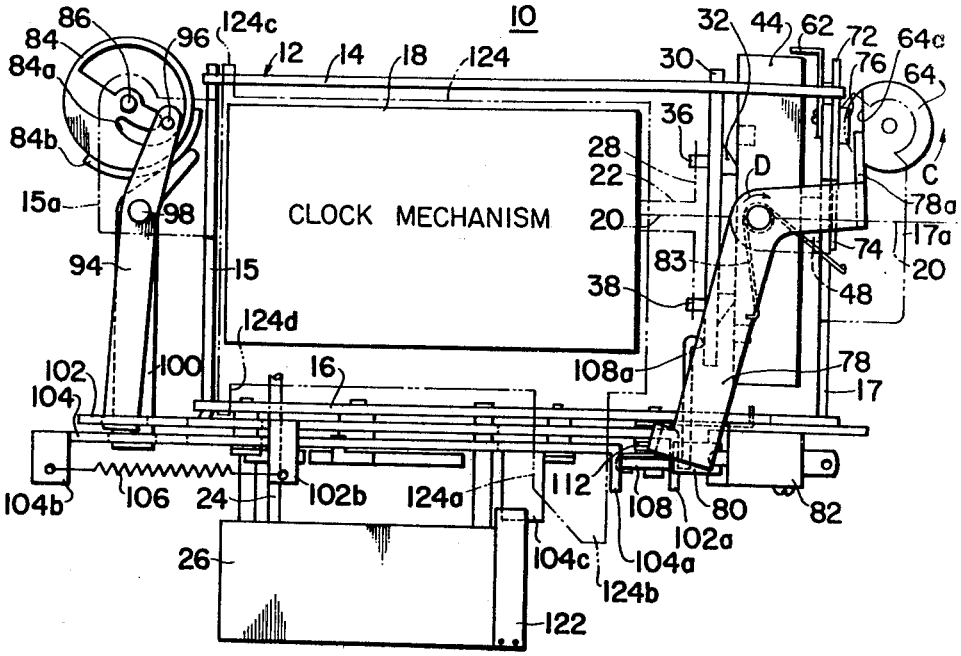
FIG. 2 shows a partially sectioned plan view of the timer shown in FIG. 1 with some of the parts shown in phantom.
Figure 4:
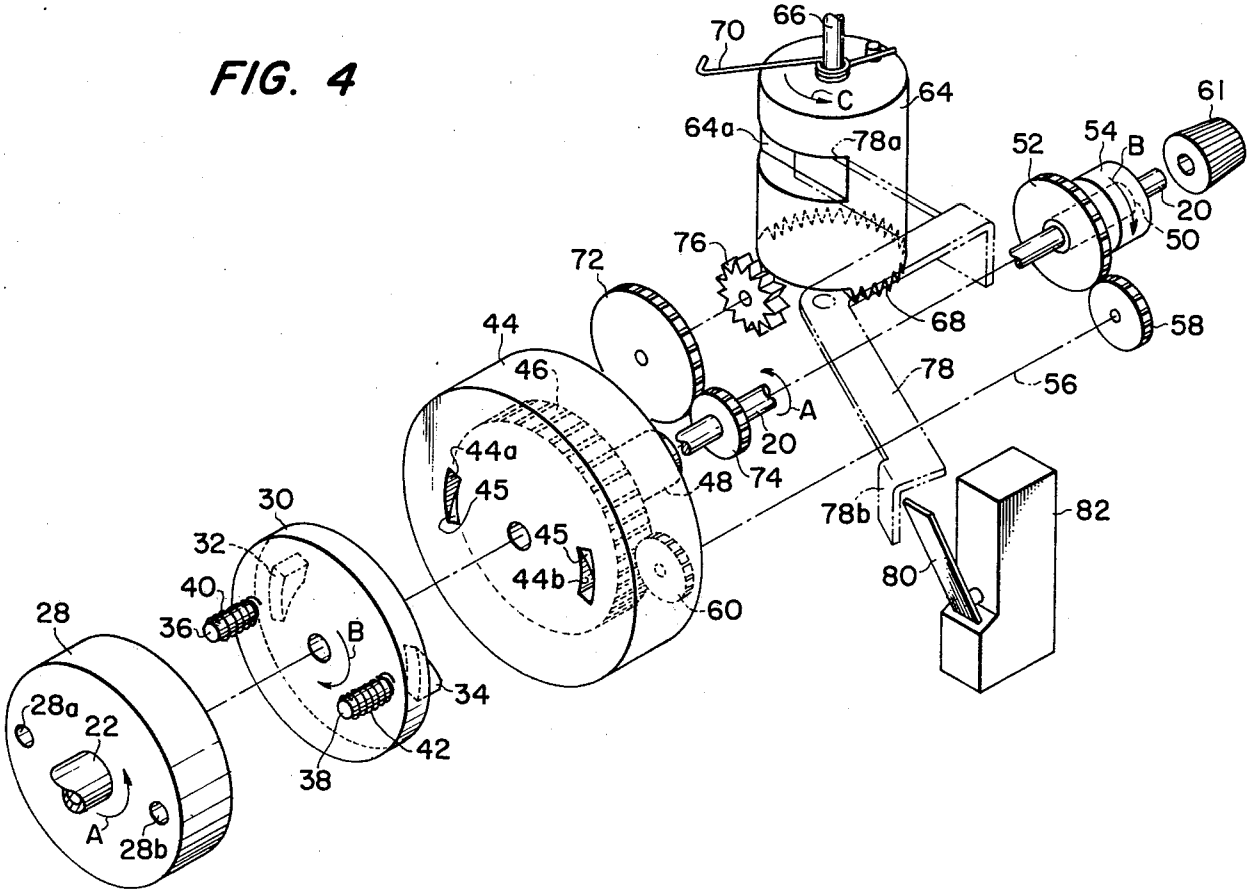
FIG. 4 shows an exploded perspective view of a sleep mechanism and its related members of the timer shown in FIGS. 1 through 3, FIGS. 5A through 5D show plan views of a control member of the timer shown in FIGS. 1 through 3 in different set positions.

Referring now to FIG. 1 and FIG. 4, there is shown a timer 10 according to the present invention, which comprises a rectangular frame 12 formed by four wall plates 14 through 17. A clock mechanism 18 having a "minute" shaft 20 and an "hour" shaft 22 is mounted inside the rectangular frame 12 so that the "minute" shaft 20 extends outwardly through the wall plate 17. The clock mechanism 18 is driven through a rotary drive shaft 24 of a synchronous motor 26 fixedly mounted on the wall plate 16. Any type of conventional clock mechanisms may be used as the clock mechanism 18. In the present embodiment, the "hour" shaft 22 which rotates one revolution per day (i.e. 24 hours) in the direction of an arrow A has, at its one end, a disk portion 28 having holes 28*a* and 28*b* and is loosely mounted on the "minute" shaft 20 also rotating in the direction of the arrow A. Inside the frame 12, a clutch disk 30 having two projections 32 and 34 generally in triangle shape and two studs 36 and 38 (FIG. 4) on opposite surfaces thereof is loosely mounted on the "minute" shaft 20 with its studs 36 and 38 being inserted into the holes 28*a* and 28*b* of the disk portion 28 of the "hour" shaft 22 so that the clutch disk 30 cannot only be rotated interlockingly with the "hour" shaft 22 in the direction of the arrow A but also move along the "minute" shaft 20. Coil springs 40 and 42 respectively surrounding the studs 36 and 38 are provided between the disk portion 28 of the "hour" shaft 22 and the clutch disk 30 so as to continuously urge the clutch disk 30 in the rightward direction seen in FIG. 2. Between the clutch disk 30 and the wall plate 17, a timer set drum 44 having a coaxial gear 46 and a boss portion 48 is also mounted loosely on the "minute" shaft 20 with its boss portion 48 engaging with the inner surface of the wall plate 17. Therefore, the projections 32 and 34 of the clutch disk 30 normally abuts on one surface of the timer set drum 44 as shown in FIG. 2 under the tension of the springs 40 and 42. The timer set drum 44 provides with dimples or recesses 44*a* and 44*b* capable of receiving the projections 32 and 34 of the clutch disk 30 at the positions corresponding to those of the projections 32 and 34. Therefore, when the positions of the projections 32 and 34 and the recesses 44*a* and 44*b* are aligned with each other due to the rotation of the clutch disk 30 in the direction of the arrow A, the clutch disk 30 will move rapidly in the rightward direction from the position shown in FIG. 2 and the projections 32 and 34 will be received by the recesses 44*a* and 44*b* respectively. Since each of the recesses 44*a* and 44*b* includes a cam portion 45 as clearly shown in FIG. 4, with the succeeding rotation of the clutch disk 30 the projections 32 and 34 will smoothly move away from the recesses 44*a* and 44*b* and the clutch disk 30 will move in the leftward direction against the springs 40 and 42. As shown in FIG. 4, a sleeve 50 integrally providing a gear 52 is loosely mounted on the outwardly extending portion of the "minute" shaft 20 and a knob 54 is fixed to the sleeve 50. An auxiliary shaft 56 (shown schematically in FIG. 4) penetrating the wall plate 17 and having gears 58 and 60 at its opposite ends is disposed in parallel with the "minute" shaft 20 so that the gears 60 and 58 can be meshed with the coaxial gear 46 of the timer set drum 44 and the gear 52 respectively. Hence, the timer set drum 30 can be rotated by the manual operation of the knob 54 through the gears 52, 58, 60 and the coaxial gear 46. However, since a suitable directional clutch (not shown) is provided in the timer set drum 30, both of the timer set drum 30 and knob 54 can only rotate in the direction of an arrow B. The peripheral surface of the timer set drum 30 is divided into 24 segments and the numerals which indicate the hour of a day are attached to each segment. An indicating pointer 62 (FIG. 2) extending in front of the peripheral surface of the timer set drum 30 is fixed to the wall plate 17 so that the user of the timer 10 can set the desired time by rotating the timer set drum 44 and aligning the desired time indication on the timer set drum 44 with the indicating pointer 62.

A "sleep" setting member 64 fixed to a shaft 66 is rotatably supported by horizontally bent portions 17*a* and 17*b* of the wall plate 17. The "sleep" setting member 64 includes a cam slot 64*a* at its peripheral surface and a partial crown gear 68 at its bottom end and is continuously biased by a spring 70 in the counterclockwise direction i.e. the direction of an arrow C. On the other hand, a gear 72 which is in meshed engagement with a gear 74 fixed to the "minute" shaft 20 is rotatably supported on the outer surface of the wall plate 17. Another gear 76 frictionally engaged with the gear 72 is also provided coaxially with the latter so that the former can mesh with the partial crown gear 68 of the "sleep" setting member 64. The gear 76 is rotated together with the gear 72 due to the friction therebetween unless other force is applied to the gear 76. However, if the rotational force which exceeds the frictional force between the gears 72 and 76 is applied to the gear 76, the gear 76 is rotated independently of the rotation of the gear 72. In the condition where the partial crown gear 68 of the "sleep" setting member 64 is not meshed with the gear 76, the "sleep" setting member 64 is held in a rest position shown in FIG. 1, 2 and 3 by the spring 70 and a suitable stopper means (not shown) which restricts further rotation of the "sleep" setting member 64 in the direction of the arrow C from the position shown in FIGS. 1 through 4. A knob 77 is fixed to the upper end portion of the shaft 66 so that the "sleep" setting member 64 can be rotated, by manual operation of the knob, into the desired angular position from the rest position shown in FIGS. 1 through 4. Rotatably supported on a horizontally bent portion 17*c* of the wall plate 17 is a switch lever 78 having at one end thereof an arm 78*a* engageable with the cam slot 64*a* of the "sleep" setting member 64 and at the other end thereof a downwardly bent portion 78*b* engageable with an actuator 80 of a microswitch 82 which is fixed to the wall plate 16 and is connected, as a power switch, to a radio set (not shown) or the like. The switch lever 78 is biased in the clockwise direction i.e. in the direction of an arrow D by means of a spring 83, so that if the "sleep" setting member 64 is in the rest position shown in FIGS. 1 through 4 the arm 78*a* of the switch lever 78 is engaged with the cam slot 64*a* and the downwardly bent portion 78*b* of the switch lever 78 is disengaged from the actuator 80 of the microswitch 82.

At the position opposite to that of the "sleep" setting member 64 with respect to the rectangular frame 12, a control member 84 having cams 84*a* and 84*b* at the upper end surface and the peripheral surface thereof is rotatably supported, through a shaft 86 to which the control member 64 is fixed, between horizontally bent portions 15*a* and 15*b* of the wall plate 15. The control member 84 also has a indicating portion 84*c* which indicates the different angular positions of the control member 84 through a window 85 of a suitable casing (not shown) of the timer 10. A knob 87 is fixed to the upper end of the shaft 86 so that the user of the timer 10 can rotate the control member 84 into the desired set position. A gear wheel 88 consisting of a click mechanism or a positioning mechanism 90 together with a flexible detent member 92 fixed to the outer surface of the wall plate 15 is fixedly mounted on the shaft 86 at the position between the control member 84 and the horizontally bent portion 15*b*. The control member 84 is positioned into four different angular positions shown FIGS. 5A through 5D by the function of the click mechanism 90. These four different angular positions will be described later.

A first connecting lever 94 having, at one end thereof, a downwardly extending pin 96 engageable with the cam 84*a* of the control member 84 is pivotably supported on a shaft 98 which is fixed to the horizontally bent portion 15*a* of the wall plate 15. A second connecting lever 100 having, at one end thereof, an arm 100*a* engageable with the cam 84*b* of the control member 84 is also supported pivotably on the shaft 98. The first and second connecting levers 94 and 100 extend along with the wall plate 15 and are loosely connected, at their other ends, to a first and a second slide plates 102 and 104 respectively, which are slidably mounted on the wall plate 16 through well-known pin and slot engagements 103 and 105. The first slide plate 102 provides with, at its one end, a bent portion 102*a* engageable with the actuator 80 of the microswitch 82 and a horizontally bent portion 102*b* at its intermediate portion. The second slide plate 104 provides with, at its one end, a similar bent portion 104*a* facing to the bent portion 102*a* of the first slide plate 102, a horizontally bent portion 104*b* at its other end and a buzzer stopper 104*c* extending rearwardly at the position near the bent portion 104*a*. A contract spring 106 is provided between the horizontally bent portions 104*a* and 104*b* of the first and second slide plates 102 and 104 so that the first slide plate 102 is urged in the leftward direction with respect to the second slide plate 104 and that the second slide plate 104 is urged in the rightward direction with respect to the first slide plate 102. An actuating lever 108 having a forwardly extending arm 108*a* is pivotally supported on a shaft 110, which is fixed to the wall plate 16, with its free end positioned between the bent portions 102*a* and 104*a* of the first and second slide plates 102 and 104. The forwardly extending arm 108*a* of the actuating lever 108 is extended through a window 16*a* formed in the wall plate 16 over the clutch disk 30 so that the free end of the arm 108*a* can be engaged with the one surface of the clutch disk 30. A spring 112 which has a stronger tension than that of the contract spring 106 is provided on the shaft 110 so as to urge the actuating lever 108 in the clockwise direction i.e. the direction of an arrow E.

A "snooze" operating member 114 made of plastics is pivotably mounted on a stud 116 fixed to the wall plate 16, with its one arm 114*a* connected to the second slide plate 104 through a pin and slot engagement so that the "snooze" operating member 114 could be rotated in accordance with the movement of the second slide plate 104. The other arm 114*b* of the "snooze" operating member 114 has a circular arc shape arm 114*c* having at its free end portion teeth 118 engageable with a gear 120 which is fixed to the drive shaft 24 of the synchronous motor 26. A vibrating reed 122 engageable with the buzzer stopper 104*c* of the second slide plate 104 is provided on a casing of the motor 26 so that the reed 122 could be vibrated by the leakage flux from the motor 26. If the vibrating reed 122 is not engaged with the buzzer stopper 104*c* of the second slide plate 104, the vibrating reed 122 is vibrated by the leakage flux from the motor 26 and generates a buzzing sound since the vibrating reed 122 will sequentially hit the casing of the motor 26 during its vibration. The vibration of the vibrating reed 122 is forcibly prevented by the buzzer stopper 104*c* of the second slide plate 104 when the stopper 104*c* is engaged with the reed 122.

A "snooze" actuating member 124 having a obliquely and downwardly bent arm 124*a* with a inclined cam portion 124*b* is pivotably supported by the wall plates 14 and 16 so that the "snooze" actuating member can rotate in a direction of an arrow F with its projecting portions 124*c* and 124*d* being as a falcrum. The "snooze" actuating member 124 is urged in the opposite direction of the arrow F by a spring (not shown) and is normally held in the position shown in FIG. 3 by means of a suitable stopper means. When the "snooze" actuating member 124 is depressed downwardly i.e. in the direction of the arrow F, the inclined cam portion 124*b* is brought into engagement with the side portion of the buzzer stopper 104*c* and, therefore, the force toward the left i.e. the direction of an arrow G is applied to the second slide plate 104 by the successive downward movement of the "snooze" actuating member 124.

Operation of the timer mechanism 10 according to the present invention is as follows.

1. MANUAL SWITCH-OFF OPERATION

Figure 3:
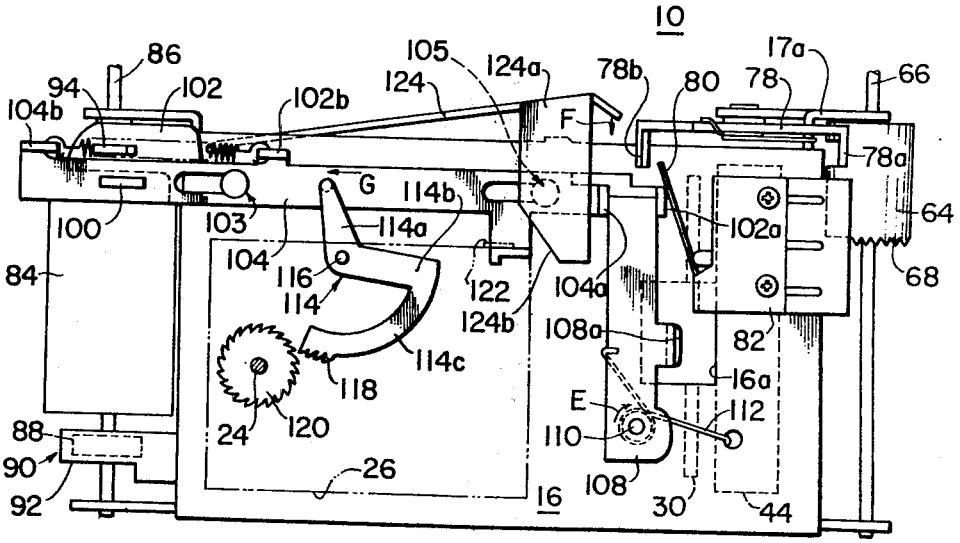
FIG. 3 shows a rear view of the timer shown in FIGS. 1 and 2 with a synchronous motor shown in phantom.

Assuming that the control member 84 is brought into the position shown in FIGS. 1 through 3 and 5B by the manipulation of the knob 87 when the "sleep" setting member 64 is in its rest position shown in FIGS. 1 through 3, the first and second connecting levers 94 and 100 would be rotated in the clockwise direction since the downwardly extending pin 96 fixed to the first connecting lever 94 and the arm 100*a* of the second connecting lever 100 are shifted in the rightward direction by the cams 84*a* and 84*b* of the control member 84. Accordingly, the first and second slide plates 102 and 104 are moved to the left i.e. in the direction of the arrow G and the actuaating lever 108 is rotated by the bent portion 102*a* of the first slide plate 102 in the counterclockwise direction i.e. the direction of the arrow E against the spring 112. Therefore, the first and second connecting levers 94 and 100, the first and second slide plates 102 and 104 and the actuating lever 108 are forcibly held in the positions shown in FIGS. 1 through 3. In this condition, the microswitch 82 is held in OFF condition because the bent portion 102*a* of the first slide plate 102 is held in the retracted position with respect to the actuator 80 of the microswitch 82 and can not push the actuator 80. As is apparent from the foregoing description, if the "sleep" setting member 64 is in its rest position shown in FIGS. 1 through 4, the microswitch 82 is is forcibly held in OFF condition when the control member 84 is manually set in the position shown in FIGS. 1 through 3 and 5B.

2. MANUAL SWITCH-ON OPERATION

Figure 5A:
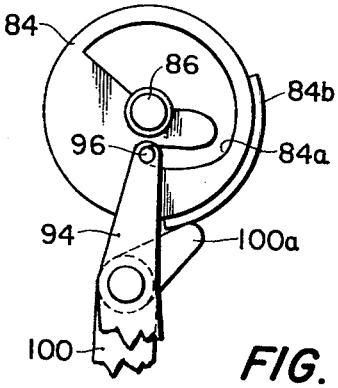
Figure 5B:
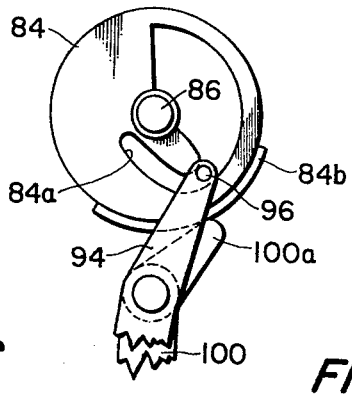
Figure 6:
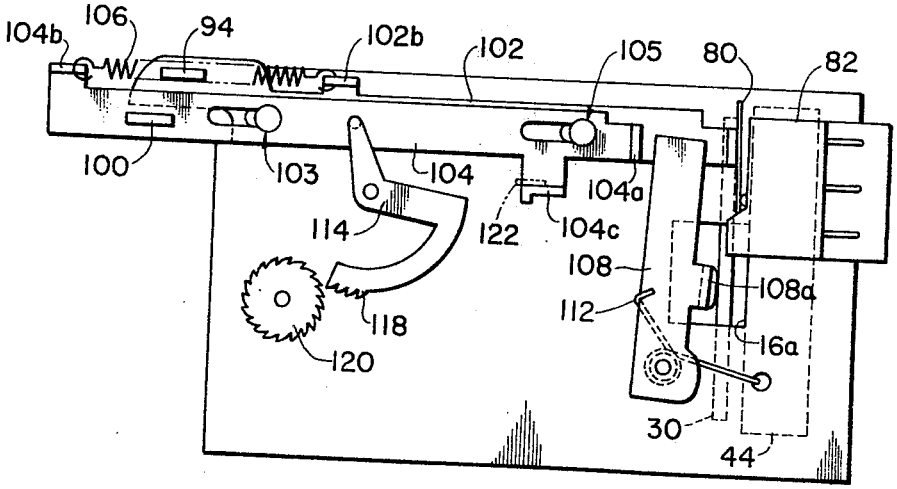
FIGS. 6 through 10 show rear views of the timer shown in FIGS. 1 through 3 in different conditions with the parts unnecessary for the explanation removed for the purpose of clarity.

Assuming that the control member 84 is manually rotated and set into the position shown in FIG. 5A, only the first connecting lever 94 is rotated in the counterclockwise direction by the cam 84*a* of the control member 84 since the arm 100*a* of the second connecting lever 100 is still engaged with the cam 84*b* of the control member 84. Accordingly, as shown in FIG. 6, the first slide plate 102 is moved to the right and is held in the position where the bent portion 102*a* thereof can push the actuator 80 of the microswitch 82 and can turn on the latter. The second slide plate 104 is held in the same leftmost position as shown in FIGS. 1 through 3 since the arm 100*a* of the second connecting lever 100 is in engagement with the cam 84*b* of the control member 84. Therefore, if the "sleep" setting member 64 is in its rest position shown in FIGS. 1 through 4, the microswitch 82 is forcibly held in ON condition when the control member 84 is manually set in the position shown in FIG. 5A.

3. TIMER OPERATION

Figure 5C:
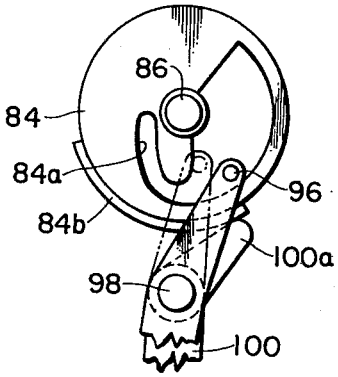
Figure 7:
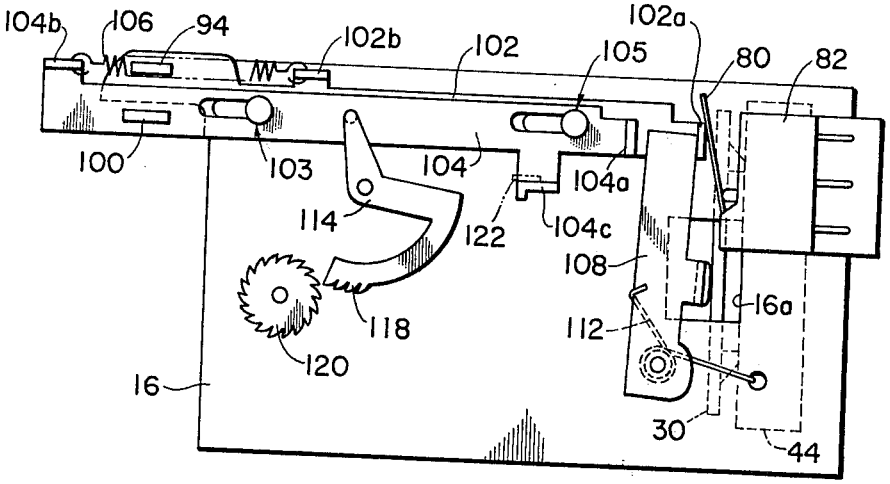

Assuming that the "sleep" setting member 64 is in the rest position shown in FIGS. 1 through 4, that the timer set drum 44 is set, for example, in the position shown in FIGS. 1 and 7 and that the control member 84 is brought into the position shown in FIG. 5C, the downwardly extending pin 96 of the first connecting lever 94 becomes movable between the position shown by the solid line and the position shown by the chain line since the downwardly extending pin 96 is released from the cam 84*a* of the control member 84. On the other hand, the actuating lever 108 is brought into the position shown in FIG. 7 when the timer set drum 44 is set as described before because the forwardly extending arm 108*a* of the actuating lever 108 is pushed against the spring 112 by the clutch disk 30 which is disengaged from the timer set drum 44 with the projections 32 and 34 thereof abutting on one surface of the drum 44. Since the second slide plate 104 is held in the leftmost position, as shown in FIG. 7, by the second connecting lever 100 which engages with the cam 84*b* of the control member 84 (FIG. 5C), the first slide plate 102 is moved in the leftward direction by the contract spring 106 until the bent portion 102*a* of the plate 102 is brought into engagement with the actuating lever 108. Therefore, under this condition, the bent portion 102*a* of the first slide plate can not push the actuator 80 of the microswitch 82 in the rightward direction and, thus, the microswitch is held in OFF condition.

Figure 8:
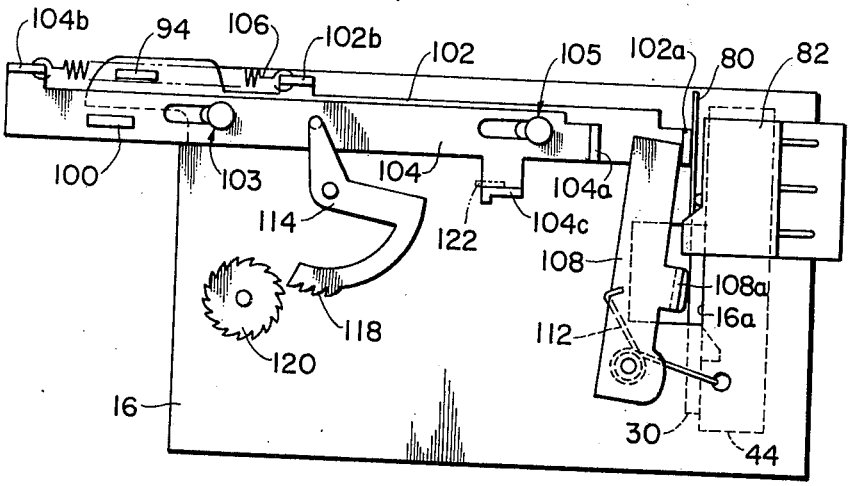

The clutch disk 30 is continuously rotated together with the disk portion 28 of the "hour" shaft 22 as time goes on. When the time set by the timer set drum 44 comes, the projections 32 and 34 of the clutch disk 30 are aligned with the recesses 44*a* and 44*b* of the timer set drum 44 and, therefore, the clutch disk 30 is rapidly moved in the rightward direction by the springs 40, 42 and 112 due to the fact that the projections 32 and 34 are respectively received by the recesses 44*a* and 44*b* as shown in FIG. 8. Accordingly, the actuating lever 108 is rotated in the clockwise direction by the spring 112 and moves the first slide plate 102 in the rightward direction. Hence, the actuator 80 of the microswitch 82 is pushed by the bent portion 102*a* of the first slide plate 102 as shown in FIG. 8 and, as a result, the microswitch 82 is turned on. Since the clutch disk 30 is continuously rotated through the "hour" shaft 22 of the clock mechanism as described before, the projections 32 and 34 moved away from the recesses 44*a* and 44*b* of the timer set drum 44 after a certain period of time, for example 1 hour, the clutch disk 30 is moved against the springs 40, 42 and 112 in the leftward direction from the position where the disk 30 is in engagement with the drum 44 (FIG. 8) to the position where the disk 30 is disengaged from the drum 44 (FIG. 7). Accordingly, the actuating lever 108 is rotated in the counterclockwise direction against the spring 112 and the first slide plate 102 is moved back to the position shown in FIG. 7 by the spring 106. Therefore, the microswitch 82 is turned off again. This operation will be repeated at each 24 hours as far as the control member 84 is set in the position shown in FIG. 5C. As is apparent from the above description, when the control member 84 is set in the position shown in FIG. 5C, it is possible to automatically operate a load such as a radio set or the like to which the microswitch 82 is connected for a certain period of time after the time set by the timer set drum 44 has come.

4. TIMER OPERATION PLUS BUZZER OPERATION

Figure 5D:
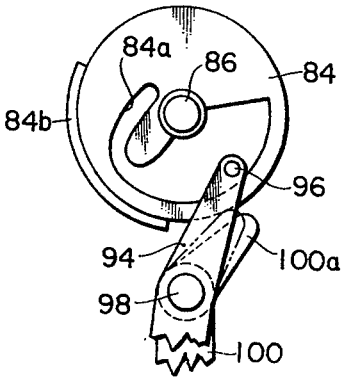
Figure 9:
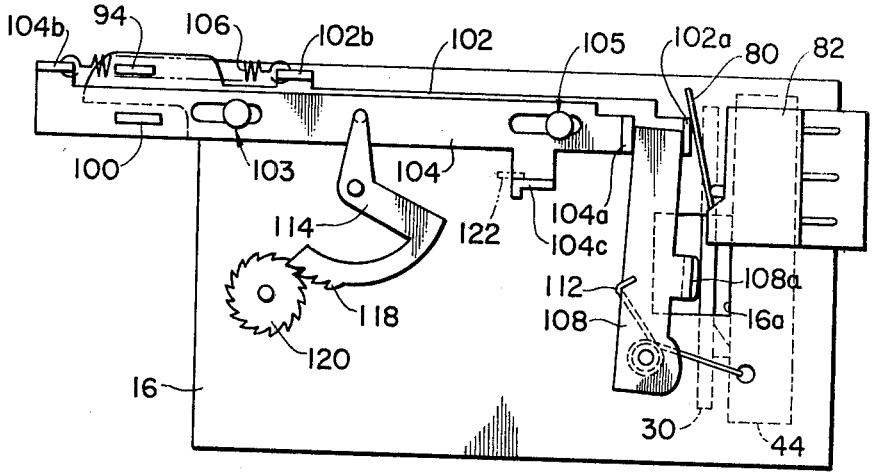

Assuming that the "sleep" setting member 64 is in the rest position shown in FIGS. 1 through 4, that the timer set drum 44 is set, for example, in the position shown in FIGS. 1 and 9 and that the control member 84 is brought into the position shown in FIG. 5D, both of the first and second connecting levers 94 and 100 become rotatable in the counterclockwise direction from the positions shown by the solid lines in FIG. 5D since the downwardly extending pin 96 and the arm 100*a* are released from the cams 84*a* and 84*b* of the control member 84. Therefore, the first and second slide plates 102 and 104 are brought into the positions shown in FIG. 9 by the spring 106 with their bent portions 102*a* and 104*a* engaged with the actuating lever 108 which is held by the clutch disk 30 in the position shown in FIG. 9 against the spring 112. On the other hand, since the "snooze" operating member 114 is rotated in the clockwise direction by the rightward movement of the second slide plate 104, the gear 118 is brought into meshed engagement with the gear 120 as shown in FIG. 9. In this condition, though the second slide plate 104 is in the position slightly shifted to the right from the position shown in FIGS. 6 through 8 as described above, the buzzer stopper 104*c* is still engaged with the vibrating reed 122. Since the teeth 118 of the "snooze" operating member 114 is meshed with the gear 120 continuously rotating in the counterclockwise direction, the gear 120 tends to rotate the "snooze" operating member 114. However, since the "snooze" operating member 114 can not be further rotated in the clockwise direction from the position shown in FIG. 9 as far as the actuating lever 108 is in a position shown in FIG. 9, the circular arc shape arm 114*c* is slightly deformed inwardly as the gear 120 rotates and the teeth 118 slip on the teeth of the gear 120.

Figure 10:
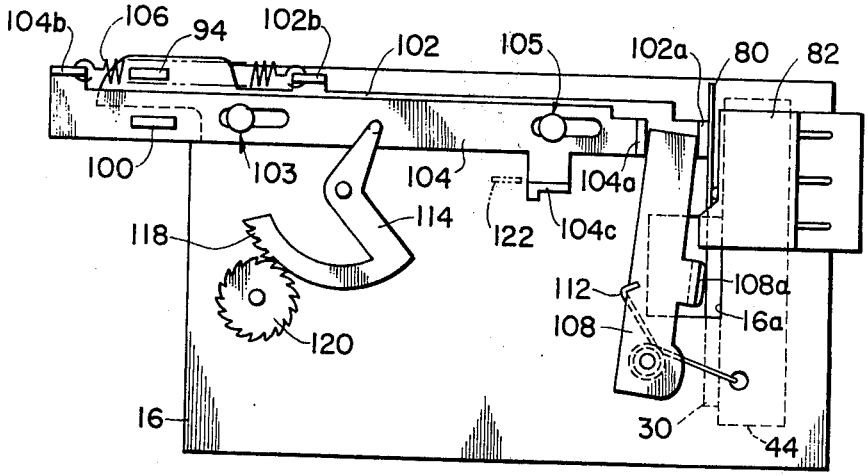

When the time set by the timer set drum 44 comes, the clutch disk 30 is rapidly moved from the position shown in FIG. 9 to the position shown in FIG. 10 as in the same manner described before. At the same time, the microswitch 82 is turned on because the actuating lever 108 moves the first slide plate 102 to the position shown in FIG. 10 upon the rightward movement of the clutch disk 30.

Since the second slide plate becomes movable in the rightward direction from the moment the lever 108 has moved to the position shown in FIG. 10, the "snooze" operating member 114 is rotated in the clockwise direction shifting slowly the second slide plate 102 in the rightward direction. The teeth 118 is gradually advanced as the gear 120 rotates. When the meshed engagement between the teeth 118 and the gear 120 is terminated the second slide plate 104 is rapidly brought into the position shown in FIG. 10, where the buzzer stopper 104*c* is disengaged from the vibrating reed 122, by the spring 106. Therefore, at the moment the second slide plate 104 is shifted to the position shown in FIG. 10, the vibrating reed 122 generates the buzzing sound. As is apparent from the foregoing description, though the time period from the moment the microswitch 82 is turned on to the moment the vibrating reed 122 generates the sound is suitably determined by selecting the number of the teeth of the gear 120 and teeth 118 of the "snooze" operating member, usually such time period is selected to be about 5 to 10 minutes. The vibration of the vibrating reed 122 can be intentionally stopped by setting the control member 84 into the position shown in FIG. 5C, because the second slide plate 104 is forcibly brought into the leftmost position as shown in FIGS. 7 and 8. Furthermore, the vibration of the vibrating reed 122 can be temporarily stopped by depressing the "snooze" actuating member 124, as will be described later.

Subsequent to the operation described above, the clutch disk 30, the actuating lever 108 and the first slide plate 102 will be returned to the position shown in FIG. 9 after a certain period of time as in the same manner explained with reference to "Timer operation" and, therefore, the microswitch 82 is again turned off. At the same time, since the second slide plate 104 is brought into the position shown in FIG. 9 by the actuating lever 108, the "snooze" operating member 114 is rotated in the counterclockwise direction with its arm 114*c* slightly deformed inwardly and with its teeth 118 slided on the teeth of the gear 120 and is brought into the position shown in FIG. 9. As is apparent from the above, the vibration of the vibrating reed 122 will be stopped after a certain period of time mentioned above even though the control member 84 is not set into the position shown in FIG. 5C, because the buzzer stopper 104*c* is again engaged with the vibrating reed 122 when the second slide plate 104 is returned to the position shown in FIG. 9.

5. "SNOOZE" OPERATION

Assuming that the "snooze" actuating member 124 (FIGS. 2 and 3) is depressed downwardly after the vibrating reed 122 generates the buzzing sound in "Timer operation plus buzzer operation" explained before, the inclined cam portion 124*b* of the "snooze" operating member 124 would push the second slide plate 104 through the buzzer stopper 104*c* thereof in the leftward direction. Accordingly, the second slide plate 104 and the "snooze" operating member 114 are forcibly returned to the position shown in FIG. 9 from the position shown in FIG. 10 and the buzzer stopper 104*c* of the second slide plate 104 is brought into engagement with the vibrating reed 122. Therefore, the buzzing sound being generated by the vibrating reed 122 is stopped by depressing the "snooze" actuating member 124. However, since the teeth 118 are still meshed engagement when the "snooze" operating lever 114 returned to the position shown in FIG. 9, the "snooze" operating lever is rotated in the clockwise direction and the second slide plate 104 is moved in the rightward direction. Therefore, the "snooze" operating lever 114 and the second slide plate 104 are again brought into the position shown in FIG. 10 after the predetermined time interval and thus the vibrating reed generates the buzzing sound again. As is apparent from the foregoing explanation, the vibration of the vibrating reed 122 is stopped at each time when the "snooze" actuating member 124 is depressed and the vibrating reed 122 generates the buzzing sound after a predetermined time interval from each depression of the "snooze" actuating member 124 while the microswitch 82 is ON condition, that is, the "snooze" operation is repeated as far as the actuating lever 108 is at least in the position shown in FIG. 10.

6. SLEEP OPERATION

Assuming that the control member 84 is in the position shown in FIGS. 1 through 3 and that the "sleep" setting member 64, is manually rotated in the desired amount in the direction opposite to that of the arrow C i.e. in the clockwise direction, the partial crown gear 68 is meshed with the gear 76 and the gear 76 is rotated or raced against the friction between the gears 76 and 72. At the same time, the switch lever 78 is rotated in the direction opposite to that of the arrow D i.e. the counterclockwise direction against the spring 83 since the peripheral surface of the "sleep" setting member 64 pushes the arm 78*a* of the switch lever 78, and thus the downwardly bent portion 78*b* of the switch lever moves the actuator 80 of the microswtich 82. This allows the microswitch 82 to be in ON condition. In this condition, if the manual rotating force to the "sleep" setting member 64 is removed, the "sleep" setting member 64 is rotated in the direction of the arrow C i.e. in the counterclockwise direction by the gear 76 which is being constantly rotated through the gear 72 and the gear 74 fixed to the "minute" shaft 20. After a certain period of time, the meshed engagement between the partial crown gear 68 and the gear 76 is terminated and the "sleep" setting member 64 is returned to the position shown in FIG. 1 through 4 by the spring 70 (FIG. 4) and the suitable stopper means (not shown). Therefore, the switch lever 78 is rotated in the clockwise direction i.e. in the direction of the arrow D by the spring 83 and the microswitch is turned off again. As is apparent from the above description, since the time period while the microswitch 82 is held in ON condition i.e. the "sleep" operation time is determined by the amount of rotated angle of the "sleep" setting member 64, desired "sleep" operation time may be conveniently set if a time graduation is attached in connection with the knob 77.

What is claimed is:

1. A timer to be built in a radio set or the like, which includes a clock mechanism driven by a synchronous motor, a "sleep" mechanism, a "snooze" mechanism, a timer set drum and a clutch disk interlocked with the clock mechanism and shiftable to the position where it can engage with the timer set drum for predetermined time period from the moment the time set by the timer set drum has come, comprising a frame, a vibrating reed attached to the synchronous motor for generating the buzzing sound, a microswitch having an actuator and connected to the radio set or the like as a power switch of the latter, a first slide plate slidably mounted on the frame and having at one end thereof a bent portion engageable with the actuator of the microswitch and an arm engageable with one surface of the clutch disk, a second slide plate slidably mounted on the frame in parallel with the first slide plate and having at the middle thereof a buzzer stopper arm engageable with the vibrating reed and at one end thereof a bent portion facing with the bent portion of the first slide plate, the second slide plate being connected to the snooze mechanism, an actuating lever pivotably supported on the frame with one end thereof positioned between the bent portions of the first and second slide plates, a spring for urging said one end of the actuating lever toward the bent portion of the first slide plate, a contract spring arranged between the first and second slide plates, a control member having a pair of cams and rotatably supported on the frame so that it can be set into four different positions, a first connecting lever rotatable supported on the frame so that it couples one of said cams to the first slide plate, a second connecting lever rotatably supported on the frame so that it couples the other of said cams to the second slide plate, a switch lever pivotably mounted on the frame and coupled to the sleep mechanism through one end thereof so that, under the control of the sleep mechanism, the other end thereof can move between a position where is can open the microswitch and a position where it can close the microswitch, a snooze actuating member mounted on the frame so that it can shift when depressed the second slide plate to the position where the buzzer stopper arm is engaged with the reed, and said pair of cams being so arranged that at the first position of the control member the first slide plate is shifted to the position where it can close the microswitch, that at the second position of the control member the first slide plate is retracted to the position where it can open the microswitch, that at the third position of the control member the first slide plate is retracted to the position where it can open the microswitch that at the third position of the control member the first slide plate is retracted to the position where it can open the micro-switch but is held in movable condition toward the switch, and that the fourth position of the control member the first slide plate is retracted to the position where it can open the switch but is held in movable condition toward the switch and the second slide plate is held in the movable condition toward the switch.

2. A timer according to claim 1 in which said control member has an indicating portion for indicating the said position of said control member.

3. A timer according tro claim 1, in which said timer further comprising a click mechanism engaged with said control member, and said control member is kept in its said position by said click mechanism.

* * * * *